US005554045A

United States Patent [19]

Bethurum

[11] Patent Number: 5,554,045

[45] Date of Patent: Sep. 10, 1996

[54] LATCH FOR IC CARD CONNECTOR

[75] Inventor: Gary C. Bethurum, Laguna Niguel, Calif.

[73] Assignee: ITT Cannon, Inc., Santa Ana, Calif.

[21] Appl. No.: 492,223

[22] Filed: Jun. 19, 1995

[51] Int. Cl.[6] ..... H01R 13/64

[52] U.S. Cl. ..... 439/372; 439/953

[58] Field of Search ..... 439/362, 364, 439/359, 361, 372, 439, 440, 310, 953

[56] References Cited

U.S. PATENT DOCUMENTS

| | | | |
|---|---|---|---|
| 3,159,444 | 12/1964 | Stine, Jr. | 439/953 |
| 3,538,485 | 8/1967 | Hennessey | 439/314 |
| 3,950,059 | 4/1976 | Anhalt et al. | 439/953 |
| 4,026,623 | 5/1977 | Goodman | 439/372 |
| 4,083,619 | 4/1978 | McCormick et al. | 439/953 |
| 4,109,987 | 8/1978 | Bourdon | 439/372 |
| 4,493,525 | 1/1985 | Hall | 439/610 |
| 4,838,808 | 6/1989 | Fujiura | 439/357 |
| 5,104,329 | 4/1992 | Brown | 439/108 |
| 5,286,212 | 2/1994 | Broeksteeg | 439/108 |
| 5,310,352 | 5/1994 | Mroczkowski | 439/372 |
| 5,338,227 | 8/1994 | Nakamura | 439/607 |
| 5,368,496 | 11/1994 | Ranalletta | 439/372 |
| 5,376,016 | 12/1994 | Inaba | 439/364 |
| 5,387,110 | 2/1995 | Kantner | 439/59 |
| 5,411,402 | 5/1995 | Bethurum | 439/77 |

*Primary Examiner*—Hien D. Vu
*Attorney, Agent, or Firm*—Thomas L. Peterson

[57] ABSTRACT

A plug connector is provided that has a latching mechanism for locking to a receptacle connector at the rear of an IC card, wherein the latching mechanism occupies a minimum of space which otherwise could be occupied by additional contacts. The latch mechanism includes a pin-shaped latch (40, FIG. 3) which is rotatable about a latch axis (80) and which has a pair of radial projections (84, 86) at its forward end, so when the projections are inserted into the receptacle housing and turned 90°, the projections prevent withdrawal of the latch and therefore prevent withdrawal of the plug connector. An actuator (44) for operating the latch, includes a pair of handles (46, 48) at opposite side edges of the plug connector and a crossbar (104) that connects them and that has a pin (106) which extends into a helical groove (102) at the rear of the latch. The hole (116, FIG. 10) in the receptacle connector housing is an undercut hole which forms a pair of forwardly-facing shoulders (112) for abutting shoulders (90) at the rear ends of the projections.

10 Claims, 3 Drawing Sheets

LATCH FOR IC CARD CONNECTOR

BACKGROUND OF THE INVENTION

IC cards, which are of about the same width and length as a typical credit card, have connectors at their front ends for engaging a connector in a card-receiving slot of an electronic device such as a notebook computer. As defined by PCMCIA (Personal Computer Memory Card International Association) the cards have a width and length of 54 mm and 85.6 mm respectively, with three different types having thicknesses of 3.3 mm, 5 mm and 10.6 mm. Some more recent cards allow connection of the card to a local area network (LAN) by providing a receptacle connector at the rear of the IC card. An adapter cable assembly has a plug connector at its front end that plugs into the receptacle connector at the rear of the card. U.S. Pat. Nos. 5,387,110 and 5,411,402 describe plug connectors of this type.

Although prior plug connectors of the above type commonly provided 22 contacts, newer IC card designs require a larger number of contacts. One type of connector having the physical format of the PCMCIA card type II (height or thickness of 5.0 mm) has a pluggable front end of a width of 28.80 mm and requires a minimum of 36 contacts. The design must include provisions for keying (to assure insertion in the proper orientation) and a latching mechanism with locking capability. One type of prior art latching mechanism described in each of the above two patents, includes a pair of arms projecting forwardly from the plug connector and insertable into an aperture of the receptacle connector. Each arm has a lateral projection that prevents unmating of the connectors until flat handles on the top and bottom of the plug connector are moved rearwardly to allow the arm to deflect toward each.

A major disadvantage of the above-described latch mechanism is that it occupies considerable space that could otherwise be occupied by contacts. For example, U.S. Pat. No. 5,387,110 provides a lateral width for the latching mechanism, that otherwise could accommodate a lateral row of six contacts. If upper and lower rows of contacts are provided, then such a latch would occupy space that otherwise could accommodate twelve contacts. It would be desirable if a latching mechanism were provided that occupied less lateral space.

In some applications, an electronic device may have two or more card-receiving slots stacked one above the other, and two or more plug connectors can mate with the rear ends of the stacked cards. In that case, it is difficult to gain access to flat handles at the top and bottom of a connector to unlatch it so that the connector can be pulled out. A latching system which enabled operation even though it was part of a plug connector lying in a stack, would be of value.

SUMMARY OF THE INVENTION

In accordance with one embodiment of the present invention, a plug connector and a combination of a plug connector and IC card receptacle connector are provided, which include a latching mechanism that occupies minimal space to maximize the number of connector contacts, and wherein the latching mechanism is easily operated. The latching mechanism includes a largely pin-like latch which is rotatably mounted on the plug housing about a latch axis, and with the front end of the latch having at least one and preferably two radial projections. As the plug connector approaches the receptacle connector to mate therewith, the front end of the latch projects into an undercut hole in the receptacle connector. Then, an actuator on the plug connector is manually operated to turn the latch so the projections move behind shoulders formed on the receptacle housing to lock the connectors together. The actuator can include a pair of handles lying at the outside of opposite side edges of the plug housing and that are slidable in forward and rearward directions and that are coupled to the latch to turn it. A crossbar extending through the plug housing, connects the handles and is coupled to a helical track at the rear portion of the latch, so forward and rearward movement of the crossbar causes rotation of the latch.

The novel features of the invention are set forth with particularity in the appended claims. The invention will be best understood from the following description when read in conjunction with the accompanying drawings.

DESCRIPTION OF THE PREFERRED EMBODIMENT

Figure 1:
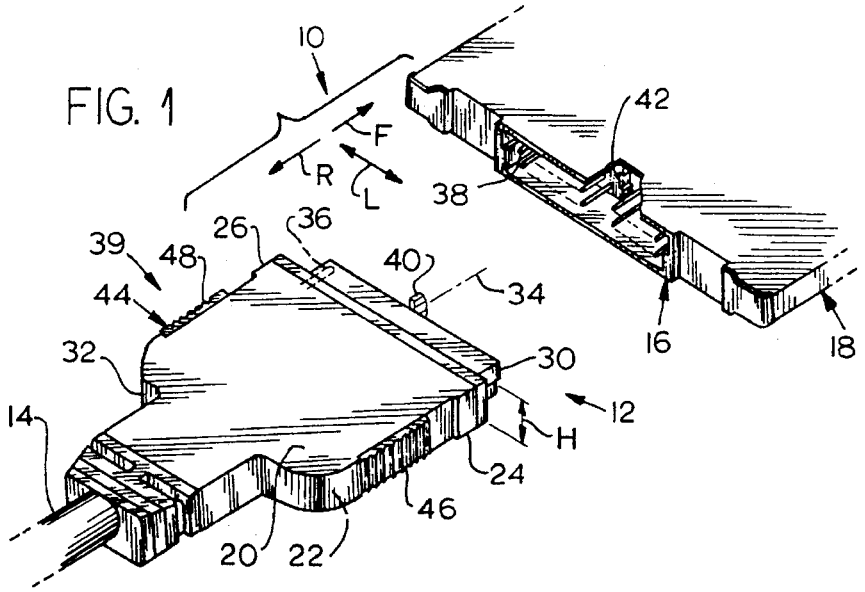
FIG. 1 is an exploded isometric view of a portion of a connector system which includes a plug connector that is mateable with a receptacle connector lying at the rear of an IC card.

FIG. 1 illustrates a connector system 10 that includes a plug connector 12 lying at the front end of a cable 14, and a receptacle connector 16 lying at the rear of an IC card 18 of the PCMCIA type. Such IC cards generally have a width of 54 mm and length 85.6 mm, and a thickness that may range between 3.3 mm and 10.5 mm, with the particular card being a type II card which has a thickness of 5 mm. The plug connector has a comparable thickness H of about 5 mm between its top 20 and bottom 22, and has a much greater width as measured in a lateral direction L between its opposite side edges 24, 26; the actual plug connector width is at least twice as great and usually about six or seven times as great as its height. The plug connector has a front and rear 30, 32, and is mated to the receptacle connector by moving the connector forwardly along a plug connector axis 34 so socket contacts 36 of the plug connector mate with pin contacts 38 of the receptacle connector. After the contacts mate, a latch mechanism 39 is operated to lock the connectors together. The latch mechanism includes a latch 40 on the plug connector that engages a latch engager 42 on the receptacle connector as the connectors mate. The latch mechanism also includes an actuator 44 having a pair of handles 46, 48 at the opposite side edges of the plug connector. The handles are moved in the forward direction F to operate the latch to lock it to the latch engager 42 and thereby prevent unmating of the connectors. The handles can be moved rearwardly to the positions shown in FIG. 1, to unlock the connectors so they can be unmated.

Figure 3:
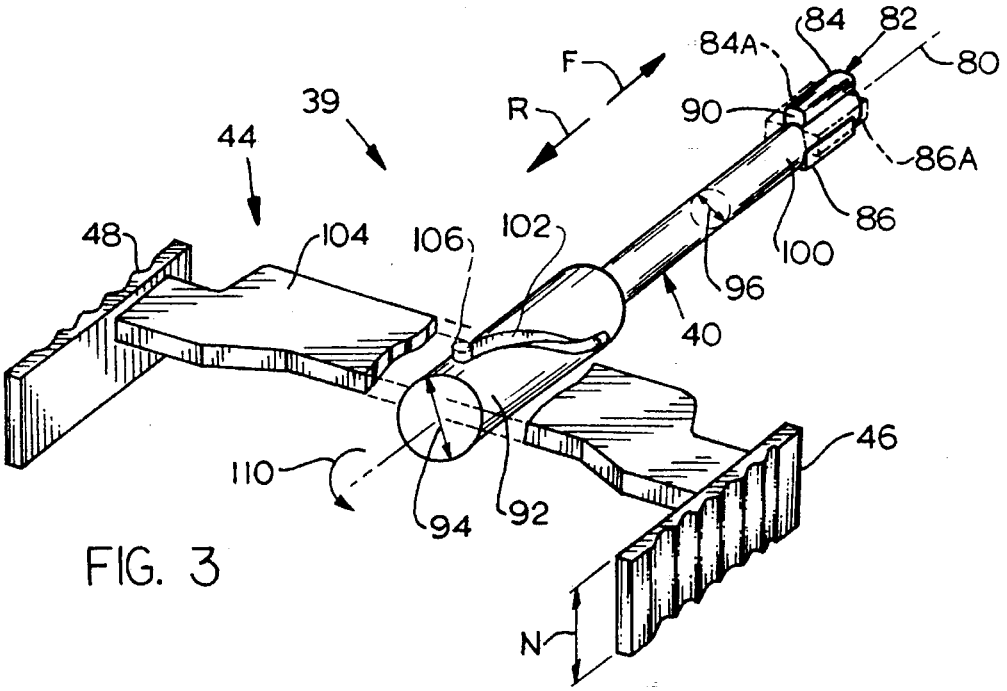
FIG. 3 is an isometric view of a portion of the latch mechanism of the plug connector of FIG. 2.
Figure 4:
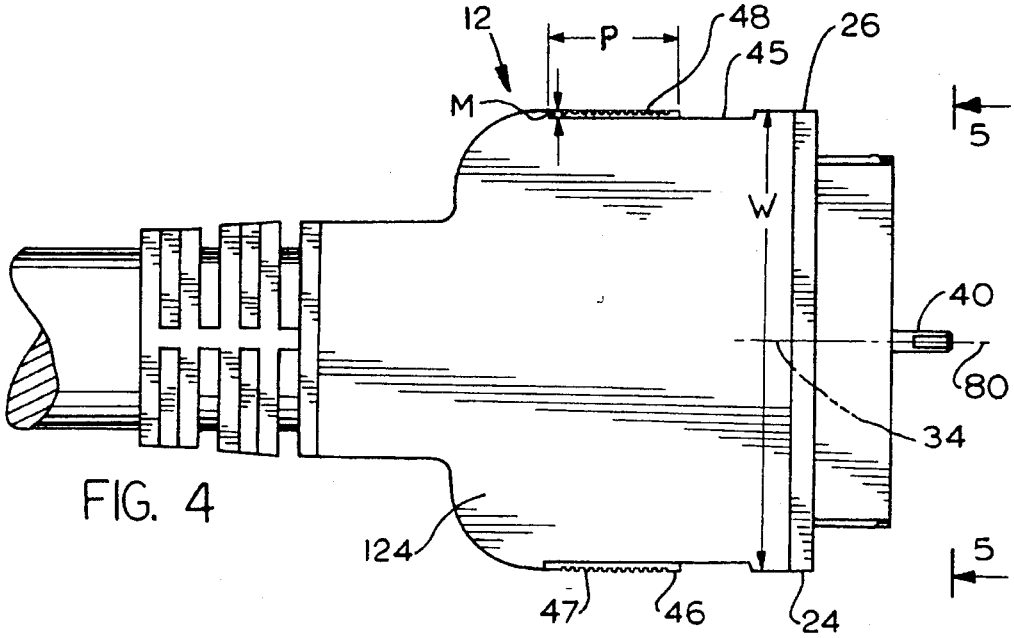
FIG. 4 is a plan view of the plug connector of FIG. 1.

As shown in FIG. 4, the handles 46, 48 lie in recesses 45 at the side edges 26, 28 of the plug connector housing 114. Each handle has a thickness M which is small to preferably lie primarily in the recess, a greater height N (FIG. 3), and an even greater length P. The outer surface 47 of each handle, which faces away from the other handle, is serrated.

Figure 2:
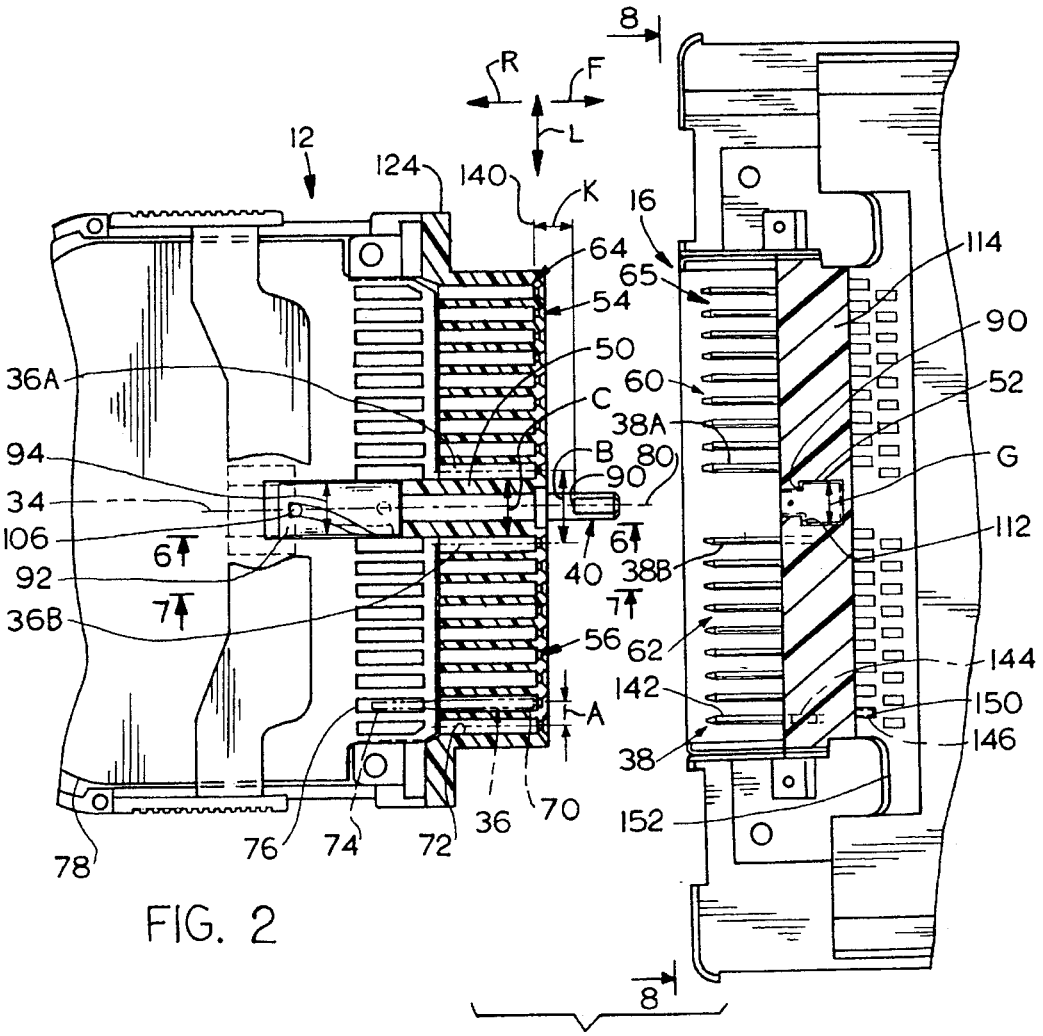
FIG. 2 is an exploded sectional top view of a portion of the system of FIG. 1.

As shown in FIG. 2, the plug connector 12 and receptacle connector 16 each have a latch region 50, 52 where there is a spacing B between a pair of contact row portions 54, 56 on the plug connector and between row portions 60, 62 on the receptacle connector. In the particular system illustrated, a row 64 of contact positions which are each designed to receive a plug contact 36, includes sixteen contacts lying in two row portions 54, 56 that each contains eight contacts, and with latch region 50 separating the contacts. Each contact 36 includes a mating contact portion 70 which is loosely received in a contact-holding region 72 of the plug housing, and each contact has a tail 74 that is soldered to a corresponding one of a row portion of traces 76 on a circuit board 78. The contact positions and the contacts thereof are spaced apart at their centers by a pitch or spacing A 0.050 inch (1.27 mm). The presence of the latch region 50 results in the two row portions 54, 56 being separated at the contact centers, by a distance B, and with the latch region occupying a slightly smaller space C.

The latch 40 is rotatably mounted about a latch axis 80 that is coincident with the connector axis 34. As shown in FIG. 3, the latch 40 has a forward end 82 that carries a pair of radial projections 84, 86 that project radially (with respect to latch axis) in opposite directions. The latches form rearwardly-facing shoulders 90. The latch has a rear portion 92 of a diameter 94 which is greater than the diameter 96 of a front portion 100 that lies immediately rearward of the projections and their shoulders 90. The rear portion has a helical track 102 formed in a cylindrical outer surface. The actuator 44 includes a crossbar 104 that extends laterally between and connects to the handles 46, 48. The crossbar carries a pin 106 that is received in the helical track 102. As the actuator 44 is moved forwardly, the pin 106 causes the latch to turn 90° in a counter clockwise direction 110 as viewed to FIG. 3, which results in the radial projections turning 90° to the positions 84A, 86A.

Figure 10:
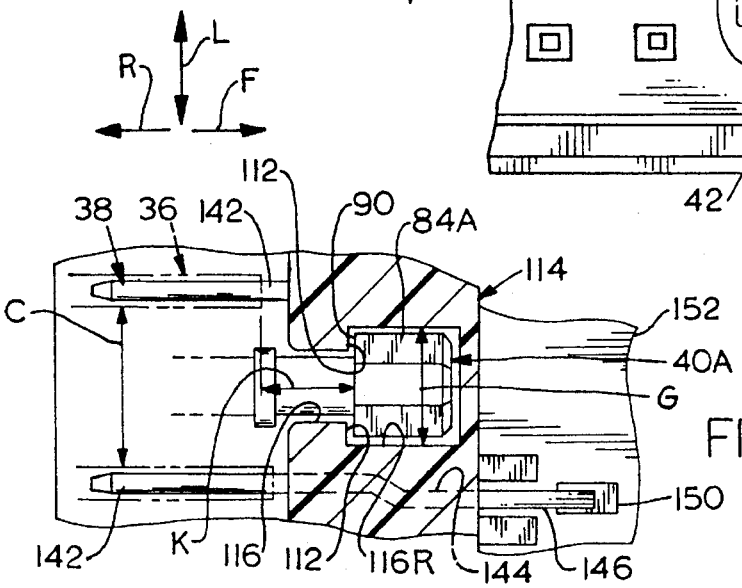
FIG. 10 is an enlarged view of a portion of the connectors of FIG. 2, in their fully mated position.

FIG. 10 shows the latch at 40A in its fully installed position in the receptacle connector, and turned 90° from its initial position. It can be seen that the shoulders 90 of the latch projections such as 84A lie immediately forward of forwardly-facing second shoulders 112 formed by the receptacle connector housing 114 along a latch-receiving hole 116 thereof. The abutment of the latch shoulders 90 and receptacle housing shoulders 112, locks the connectors together to prevent them from unmating.

Figure 9:
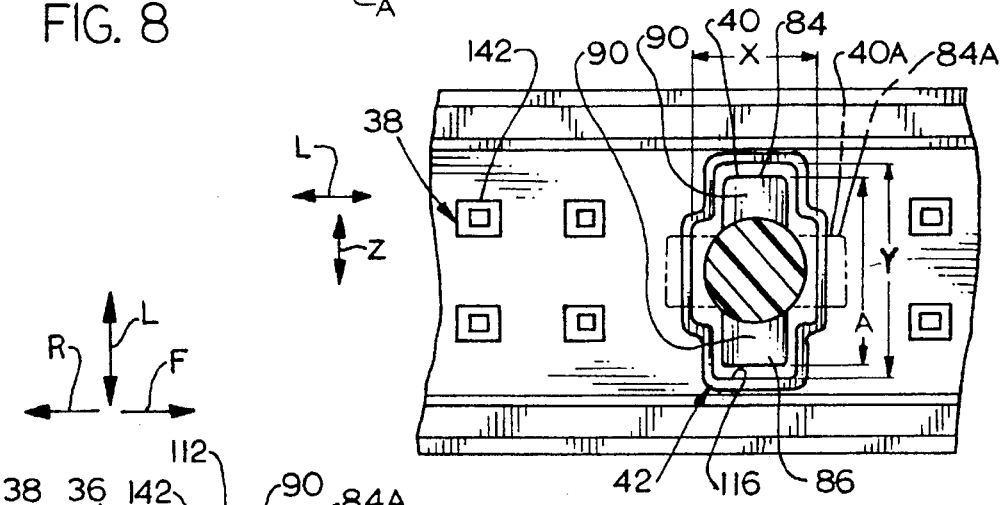
FIG. 9 is an enlarged view of a portion of the receptacle connector of FIG. 8, with the latch inserted but not yet rotated.

FIG. 9 shows that the latch-receiving hole 116 of the latch engager 42, has a height Y which is greater than its width X. This permits initial latch insertion in orientation 40, followed by a 90° rotation to orientation 40A where there is interference. The maximum width A of the latch at its projections, is less than the hole height Y but greater than the hole width X. It would be possible to orient the height Y so it extends in the lateral direction instead of the height direction Z. It also would be possible to form the hole 116 in a rotatable member (preferably on the plug connector) and not rotate the latch.

Figure 6:
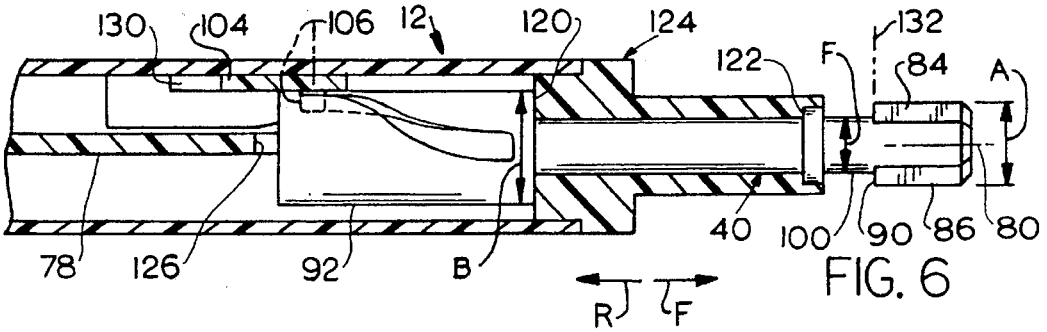
FIG. 6 is a view taken on line 6—6 of FIG. 2.
Figure 7:
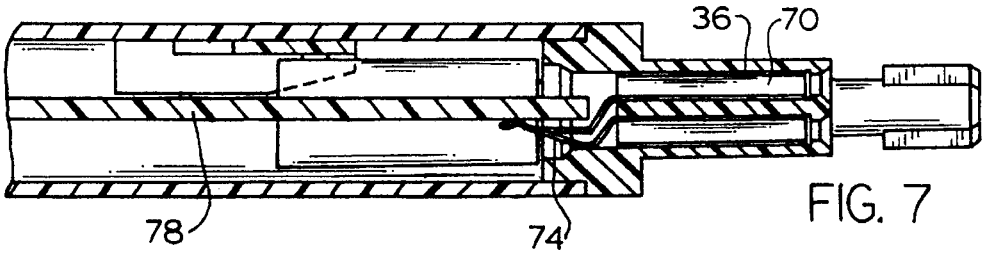
FIG. 7 is a view taken on line 7—7 of FIG. 2.

As shown in FIG. 6, the latch has shoulders 120, 122 that abut the plug connector housing 124 to prevent forward or rearward or movement of the latch with respect to the plug connector while allowing the latch to rotate. The circuit board 78 of the plug connector has a cutout 126 that receives the latch rear portion 92. The crossbar 104 has a length in the forward-rearward direction that is greater than its thickness 130, so the latch does not interfere with the circuit board 78, and yet the latch is rigid in a direction to apply forces to the pin 106. The shoulders 90 of the projections 84A, 86A both lie on an imaginary shoulder plane 132 that extends normal to the latch axis 80.

The latch forward portion 100 has a diameter F of 0.075 inch (1.9 mm). Referring to FIG. 10, the lateral distance G of the receptacle housing hole portion which receives the latch is about 0.090 inch (2.29 mm). The lateral distance C (FIG. 2) left in the plug housing is about 0.125 inch (3.18 mm), and the rear portion 92 of the latch is of about the same diameter as the distance C. As a result of the latch regions 50, 52, the distance C which otherwise could be occupied by two contacts (actually 2.5 contacts), is not so occupied, which decreases the number of contacts in the row 64. However, the decrease in the number of contacts is much smaller than in the prior art such as in U.S. Pat. Nos. 5,387,110 and 5,411,402, where the latch region occupies a lateral space that otherwise could be occupied by five contacts.

The space C that is required to hold the latch of the plug connector and that forms the hole in the receptacle connector, can be limited by the required width G of the undercut portion of the receptacle housing hole, plus the need for some space between opposite sides of the hole and adjacent receptacle contacts 38A, 38B. However, in practice, the required diameter 94 of the latch rear portion is a limiting factor, in that as the diameter 94 decreases, the possibility increases that the pin 106 will break or will not move smoothly along the helical groove, due to manufacturing tolerances. The diameter 94 is made almost as great as the distance C between the mating ends of contacts 36A, 36B that lie adjacent to the latch region, with the diameter 94 preferably being at least two-thirds, and more preferably at least 80% of the distance C between adjacent portions of the adjacent contacts 36A, 36B.

It is noted in FIGS. 2 and 10, that the front ends of the plug contacts 36 lie in a first plane 140, and that the shoulders 90 of the latch projections lie a distance K forward of the plane 140. Also, the receptacle contacts 38 have free rearward ends 142, have middles 144 that are mounted in the receptacle housing 114 as by being integrally molded therein, and have forward ends in the form of tails 146 connected to traces 150 on a circuit board 152 of the IC card. The enlarged hole portion 116R forms the shoulders 112 so the shoulders lie forward of the free ends 142 of the receptacle contacts. As a result, there is considerable housing material of receptacle housing 114 lying immediately rearward of the shoulders 112 to strengthen them. The spacing K of the latch projections enables the projections 84, 86 to fit into the enlarged hole portion of the receptacle housing, when the contacts of the two connectors are fully mated.

Figure 5:
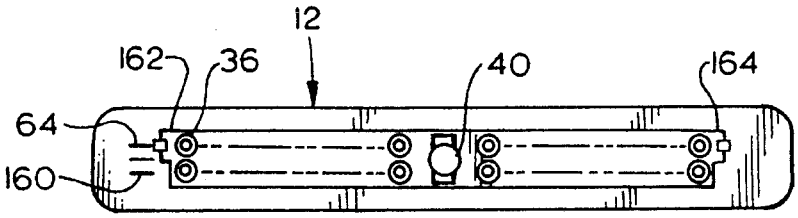
FIG. 5 is a view taken on line 5—5 of FIG. 4.
Figure 8:
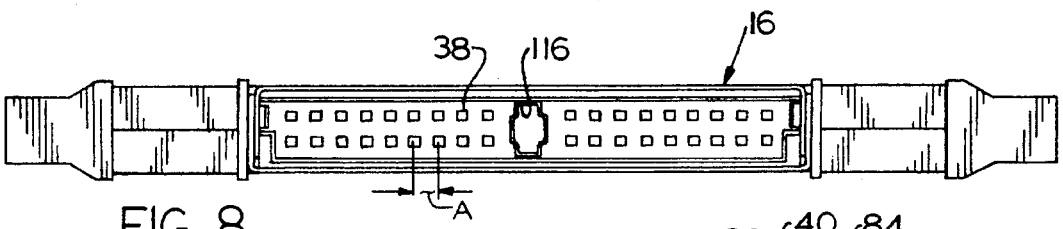
FIG. 8 is a view taken on line 8—8 of FIG. 2.

As shown in FIG. 5, the plug connector 12 has two rows of contacts 64, 160, that are each interrupted and that each includes two row portions of nine contacts each, for a total of thirty-six contacts. A pair of keys 162, 164 are formed in the plug housing to assure proper orientation of the plug connector when mated to the receptacle connector. FIG. 8 shows that the receptacle connector has corresponding rows of contacts.

Applicant has designed a connector system of the illustrated construction, with the plug having a width 170 (FIG.

5) of 1.324 inch (33.63 mm), and with the other dimensions being portional to the actual dimensions given above, as illustrated in FIGS. 2 and 5–10.

While terms such as "top", "bottom" etc. have been used to help describe the invention as illustrated, it should be understood that the connector system and its parts can be used in any orientation with respect to Earth's gravity.

Thus, the invention provides a latch mechanism for a connector system, and especially one used for an IC card where a large number of contacts may be required in an area of small height and lateral width, and which is easy to operate. The plug connector includes a latch that is rotatably mounted on the plug housing and which includes at least one and preferably two projections at its front end. The latch can be rotated by an actuator that includes a pair of handles lying at the outside of the opposite side edges of the plug housing, and that are slidable in forward and rearward directions to turn the latch. The presence of the handles at the opposite side edges of the plug connector, can facilitate operation of the actuator. This is especially so where a vertical stack of plug connectors are connected to the rear ends of a vertical stack of IC cards, so there is no room for a person to reach flat handles that may be located at the top and bosom of the plug connector. The lateral spacing of the handles, which is generally more than two centimeters, can help some people to grasp and move them. The latch preferably has a cylindrical rear portion with a helical track which is engaged by an actuator that is movable forward and rearward to turn the latch. The latch can have a pair of projections at its top and bottom but not at its sides, and the receptacle housing can be provided with an undercut hole that has a relatively large height to receive the projections during initial insertion, with a smaller width to form a pair of forwardly-facing shoulders that engage the projections when the latch is turned.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical plug connector having a plurality of plug contacts and having a plug connector axis extending in forward and rearward directions, for mating with receptacle contacts of a receptacle connector and for latching to the receptacle connector, wherein the plug connector includes a plug connector housing and a latch which is rotatably mounted in said housing about a latch axis which is substantially parallel to said connector axis, wherein said latch has a forward end with at least one radial projection that has a largely rearwardly-facing first shoulder for moving behind a largely forwardly-facing second shoulder on the receptacle connector, and wherein said plug housing has top and bottom portions and has laterally opposite side edges which are spaced apart by more than said top and bottom portions, and has front and rear portions, characterized by:

an actuator which includes a pair of handles lying outside of said housing and adjacent to said opposite side edges of said housing, said actuator being slidable longitudinally on said housing in forward and rearward directions, said handles being coupled through a crossbar means that extends across said housing between said handles to said latch to rotate said latch about said latch axis as said handles slide forwardly and rearwardly along said longitudinal directions.

2. The electrical connector described in claim 1 wherein:

each of said actuator handles has a length in a direction parallel to said axis, a height in a direction parallel to the spacing between said top and bottom, and a thickness in a direction parallel to the spacing between said opposite side edges, with said thickness being less than half said height and with said height being less than said length, and with each of said handles having a serrated exposed surface generally facing away from the other handle.

3. The electrical connector described in claim 1 wherein:

said latch has a helical track, and said crossbar means having a part engaged with said helical track and said latch being mounted to prevent said latch from moving forward and rearward while allowing said latch to turn, so as said crossbar means moves forward and rearward it causes said track to turn in first and second opposite directions about said latch axis.

4. The electrical connector described in claim 1 wherein:

said latch has a rear portion of a first diameter with a helical groove therein, and has a front part lying immediately rearward of said projection, with said front part having a smaller diameter than said rear portion;

said contacts of said plug connector are arranged in at least two laterally extending row portions which are laterally separated by said latch;

said rear portion of said latch lies between said contact row portions to separate them, and the diameter of said rear portion is at least two-thirds of the distance of separation between said contact row portions.

5. The electrical connector described in claim 1 wherein:

said plug contacts are arranged in at least one laterally-extending row with said plug contacts having a predetermined lateral center-to-center spacing along said row, except at a middle location that is partially occupied by said latch;

said contacts of said plug connector have front ends that lie substantially on a first imaginary plane that extends normal to said plug connector axis, said latch has two opposite projections with largely rearwardly-facing shoulders that lie forward of said imaginary plane, and a width of said latch at said projections is less than three times said lateral center-to-center spacing of said plug contacts.

6. The electrical connector described in claim 1, wherein:

said at least one radial projection includes two radial projections that project in radially opposite directions, and that have largely rearwardly-facing shoulders that both lie on an imaginary shoulder plane that extends normal to said latch axis.

7. A combination of an electrical plug connector that has a plug housing with front and rear portions and that has a laterally-extending row of plug contacts on said plug housing, and an electrical device that has a rear and that has a receptacle connector at said rear, said receptacle connector having a receptacle housing and a laterally-extending row of receptacle contacts on said receptacle housing for mating with said plug contacts when said plug connector moves forwardly along a connector axis toward said receptacle connector, characterized by:

an elongated latch that is rotatably mounted in said plug housing about a latch axis that extends substantially parallel to said connector axis, said latch having a rearward portion lying in said plug housing and said latch having a forward end with a pair of radial projections that project radially with respect to said latch axis and that form a pair of rearwardly-facing shoulders that are spaced apart in a width direction that is perpendicular to said latch axis, and said latch having a predetermined maximum width at said projections;

said latch having helical groove means;

an actuator mounted on said plug housing, said actuator including a pair of handles that are slidable in forward and rearward longitudinal directions and that are coupled to said helical groove means by a coupling means so that longitudinal movement of said handles rotate said latch;

said receptacle connector housing having walls forming a latch-receiving hole with a height dimension in a direction perpendicular to said connector axis, that is at least as great as said maximum width of said latch at said projections, and said latch-receiving hole having a width dimension in a direction perpendicular to both said height dimension and said axis, which is less than said width of said latch at said projections, with said walls forming said latch-receiving hole being undercut and having a pair of largely forwardly-facing shoulders for abutting said shoulders of said latch projections when said plug and receptacle are mated.

8. The combination described in claim 7 wherein:

the contacts of each of said rows are spaced apart at a predetermined center-to-center spacing, and each of said connector housings has a latch region which interrupts the corresponding row of contacts;

said device includes a circuit board with a rear end having a plurality of conductive traces;

said receptacle housing has a contact-mounting portion;

said contacts of said receptacle connector have middles lying in said housing contact-mounting portion, forward ends connected to said traces on said circuit board, and free rear ends, and said forwardly-facing shoulders lie in said contact-mounting portion of said receptacle housing at a position forward of said receptacle contact free rear ends.

9. The combination described in claim 7 wherein:

said plug housing has opposite laterally-spaced housing side edges;

said handles each lies at a different one of said housing sides and a crossbar that extends through said housing and that connects said handles;

said latch has a cylindrical rear portion with a largely helical groove, and said crossbar has a pin that projects into said helical groove, with said handles, said crossbar and said pin being slidable relative to said plug housing in a direction substantially parallel to said axis, but said latch being restrained against movement parallel to said axis while being confined to rotating about said latch axis.

10. An electrical plug connector that has a plug housing with front and rear portions and that has a laterally-extending row of plug contacts on said plug housing, characterized by:

an elongated latch that is rotatably mounted in said plug housing about a latch axis that extends substantially parallel to said connector axis, said latch having a rearward portion lying in said plug housing and said latch having a forward end with a pair of radial projections that project radially with respect to said latch axis and that form a pair of rearwardly-facing shoulders that are spaced apart in a width direction that is perpendicular to said latch axis, and said latch having a predetermined maximum width at said projections;

said latch having a helical track means;

an actuator mounted on said plug housing, said actuator including a pair of handles that are slidable in forward and rearward longitudinal directions and that are coupled to said helical track means by a coupling means so that longitudinal movement of said handles rotates said latch.

* * * * *